US006009417A

United States Patent [19]

Brookner et al.

[11] Patent Number: 6,009,417

[45] Date of Patent: Dec. 28, 1999

[54] PROOF OF POSTAGE DIGITAL FRANKING

[75] Inventors: George Brookner; Michael Brown, both of Norwalk; Fetneh Eskandari, Middletown; Robert Schwartz, Branford; Eric Zuidema, Norwalk, all of Conn.

[73] Assignee: Ascom Hasler Mailing Systems, Inc., Shelton, Conn.

[21] Appl. No.: 09/254,915

[22] PCT Filed: Sep. 24, 1997

[86] PCT No.: PCT/US97/17065

§ 371 Date: Mar. 16, 1999

§ 102(e) Date: Mar. 16, 1999

[87] PCT Pub. No.: WO98/13790

PCT Pub. Date: Apr. 2, 1998

Related U.S. Application Data

[60] Provisional application No. 60/024,756, Sep. 24, 1996.

[51] Int. Cl.[6] ..... G07B 17/00

[52] U.S. Cl. ..... 705/410; 235/375; 340/825.31; 380/51; 380/55; 705/401; 705/403; 705/408

[58] Field of Search ..... 235/375, 380, 235/825.3, 825.31, 825.35; 380/23, 24, 51, 55; 705/401, 403, 408, 410

[56] References Cited

U.S. PATENT DOCUMENTS

| | | | |
|---|---|---|---|
| 4,743,747 | 5/1988 | Fougere et al. | 235/494 |
| 4,813,912 | 3/1989 | Chickneas et al. | 705/408 |
| 4,831,555 | 5/1989 | Sansone et al. | 395/113 |
| 4,837,701 | 6/1989 | Sansone et al. | 705/404 |
| 4,853,864 | 8/1989 | Hart et al. | 705/403 |
| 5,233,657 | 8/1993 | Gunther | 380/23 |
| 5,237,506 | 8/1993 | Horbal et al. | 705/403 |
| 5,367,464 | 11/1994 | Abumehdi et al. | 705/403 |
| 5,657,689 | 8/1997 | Lee | 101/91 |
| 5,781,438 | 7/1998 | Lee et al. | 704/404 |
| 5,812,991 | 9/1998 | Kara | 705/410 |
| 5,822,738 | 10/1998 | Shah et al. | 705/410 |

*Primary Examiner*—Edward R. Cosimano
*Attorney, Agent, or Firm*—Oppedahl & Larson, LLP

[57] ABSTRACT

A proof-of-postage generating system wherein funds, application of those funds, the replenishment of those funds and the auditing of those funds are secure against attempts at fraud. The system may either be a Closed System (CS) wherein the proof-of postage printing means are housed within the system computational means or within a cryptographically secure boundary. Further, the system my be an Open System (OS) wherein the proof-of postage printing means are external to the system computational means.

21 Claims, 6 Drawing Sheets

** ALTERNATELY, THE PSD CAN BE EXTERNAL TO THE FRANKING DEVICE (SEE FIG. 1)

PROOF OF POSTAGE DIGITAL FRANKING

This is the United States national phase of International Application number PCT/US97/17065, which claims priority from U.S. provisional application Ser. No. 60/024,756, filed Sep. 24, 1996.

TECHNICAL FIELD

The invention relates generally to postage meters, also called franking machines, and relates more particularly to electronic postage meters printing digital postal indicia.

BACKGROUND ART

Postage meters are well known. The present assignee has been designing and manufacturing postage meters for many, many decades. After these decades of experience, postage meters are extremely reliable and cost has been reduced to a minimum. A typical postage meter prints its postage by means of an intaglio-type metal or strong plastic printing plate or die plate, using specified fluorescent ink.

Most postage meter customers never have reason to call for repair of their postage meters. Postage meters are simple to operate and there is little to go wrong. They have been accepted by nearly all the post offices of the world. Postage meters benefit post offices by reducing the need for retail sales of postage stamps, and by making it easy for postal patrons to adjust to changes in postage rates. Present-day postage meters are able to accommodate mail pieces of varying thickness, and are able to print their indicia even if the surface of the mail piece is uneven.

Nothwithstanding the reliability, low cost, and ease of use of present-day postage meter designs, it has been suggested by some postal authorities that all postage meters presently in use be removed from service and that postage be printed instead by common computer printers using ordinary ink. This means that anyone with an ordinary computer printer can readily generate a plausible-looking postal indicium at any time and in any desired quantity. The only possible approach for reducing fraud, when ordinary computer printers are used, is to incorporate cryptographically secure information into the postal indicium, and to read and verify that information on each and every mail piece. The present invention is directed to system configurations in which such cryptographically secure information is generated for use in printing such indicia. To be commercially viable, such system configurations must not only satisfy the requirements of the postal authorities, but must also provide user function more or less approximating that of present-day postage meters.

SUMMARY OF THE INVENTION

A proof-of-postage generating system wherein finds, application of those funds, the replenishment of those funds and the auditing of those funds are secure against attempts at fraud. The system may either be a Closed System (CS) wherein the proof-of postage printing means are housed within the system computational means or within a cryptographically secure boundary. Further, the system my be an Open System (OS) wherein the proof-of postage printing means are external to the system computational means.

BRIEF DESCRIPTION OF THE DRAWING

The invention will be described with respect to a drawing in several figures, of which.

DETAILED DESCRIPTION OF THE INVENTION

A proof-of-postage generating system is described wherein funds, application of those funds, the replenishment of those funds and the auditing of those funds are secure against attempts at fraud. The system may either be a Closed System (CS) wherein the proof-of postage printing means are housed within the system computational means or within a cryptographically secure boundary. Alternatively, the system may be an Open System (OS) wherein the proof-of postage printing means are external to the system computational means.

As will be described in more detail below, what is provided is a Postal Security Device (PSD) within which is housed physically secure, as well cryptographically secure funds and associated accounting registers, said PSD itself being utilized within a dynamic system which provides for the interchange of data between a funds provider source, a computational funds tracking and maintenance source and a printing source. Each embodiment described below, whether an Open System (OS) or Closed System (CS), provides all necessary security against fraudulent attacks against the system. This invention is intended to provide a customers with a number of alternative approaches to optimize the customer's use, tracking, and replenishing of the customer's franking funds within the environment surrounding the dispensing of postal funds for proof-of-payment for the services required. In all cases, the proof-of-postage (postal indicium) is digitally generated data. Said digital data is represented as an image (generally, a printed image) on the mailpiece requiring said proof-of-postage. Said proof-of postage may be represented as a graphical image, human readable information, various bar codes (both 1-dimensional or 2-dimensional codes), OCR characters, etc., or any combination thereof.

The Postal Security Device (PSD) will support methods of applying postage in lieu of the present-day approach, which is typically a self-contained electromechanical or mechanical postage meter which imprints indicia on mailpieces. Described below are a number of system integration designs wherein said PSD is a small element of both large and small systems capable of supporting the needs of both large and small businesses, as well as the private citizen.

The first embodiments set forth herein relate to Closed Systems (CS) which may take the form of three different embodiments, dependent upon the needs of the customer. This CS approach provides a printing means within the franking device or within a cryptographically secure boundary as executed by a vendor. Said franking device is dedicated to the imprinting of proof-of-postage (said proof-of-postage will take the form and aesthetics required by the regulating body) and other related information (at times referred to as audit information and reports). In all cases and embodiments, the cryptographic content of the printed indicia image contains information unique to that transaction and specific PSD.

Figure 1:
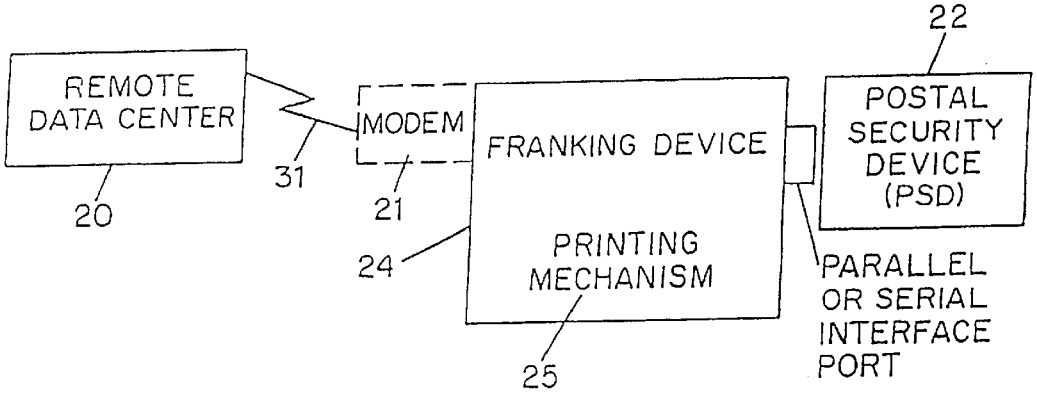
FIG. 1 is a functional block diagram of a first embodiment of a closed-system type of postage meter.

In the first embodiment of this closed system arrangement, the Postal Security Device (PSD) 22 is attached as a "dongle" (an adaptive interfacing device which connects to and uses a communications port while still allowing the port to be used by other devices) to the self contained franking device 24 (see FIG. 1). The cryptographic data content between the PSD 22 and franking device 24 is verified for authenticity (e.g. signature certificate) whereupon the printing mechanism 25 within the franking device 24 delivers the appropriate image to the mailpiece, letter or invoice. Crediting new funds to the PSD is managed by an interface (modem) 21 adapted to the franking device 24 which communicates cryptographically with a host Data Center 20 which provide funds for the PSD through the franking device 24. The communications between the franking device 24 and Data Center 20 or between the franking device 24 and PSD 22 are cryptographically encoded with all transactions being verified by the crypto-code structure and certificate authorization schema as required by the regulating body. Said PSD 22 may be moved from one franking device 24 to another so long as each franking device 24 is authorized/keyed to function with said PSD 22. In all cases the PSD 22 has the ability to account for finds and history as related to the franking device 24 to which it has been attached.

Those skilled in the art will appreciate that the communications channel 31 between the franking device 24 and the data center 20 need not be secure. The channel 31 may be a dialed voice telephone call over the public switched telephone network, with modems at each end of the line. Alternatively, the channel 31 may be an ISDN telephone call, or may be a TCP/IP session placed over any suitable physical medium and underlying protocol, such as frame relay. The communications between the franking device 24 and data center 20 may desirably be carried out as set forth in U.S. Pat. No. 5,237,506, assigned to the same assignee as the assignee of the present invention.

Those skilled in the art will also appreciate that the postal security device 22 contains an accounting register indicative of postage value, and contains cryptographic means, said cryptographic means disposed for secure communications with a remote host 20 for adjustment of the contents of said accounting register, said cryptographic means further disposed for generation of data to be included in said postal indicia, said postal security device 22 disposed to account within said accounting register for postage value provided in said postal indicia and to fail to generate such data when said accounting register satisfies a predetermined condition. In a typical arrangement, the accounting register of the PSD 22 is a descending register, and postal indicia are printed only if the value stored in the descending register is greater than the amount of postage value desired to be printed. In this way the postage printing system employing the PSD 22 mimics the well-known behavior of a present-day postage meter in which the meter refuses to print more postage if it is empty or almost empty.

Figure 2:
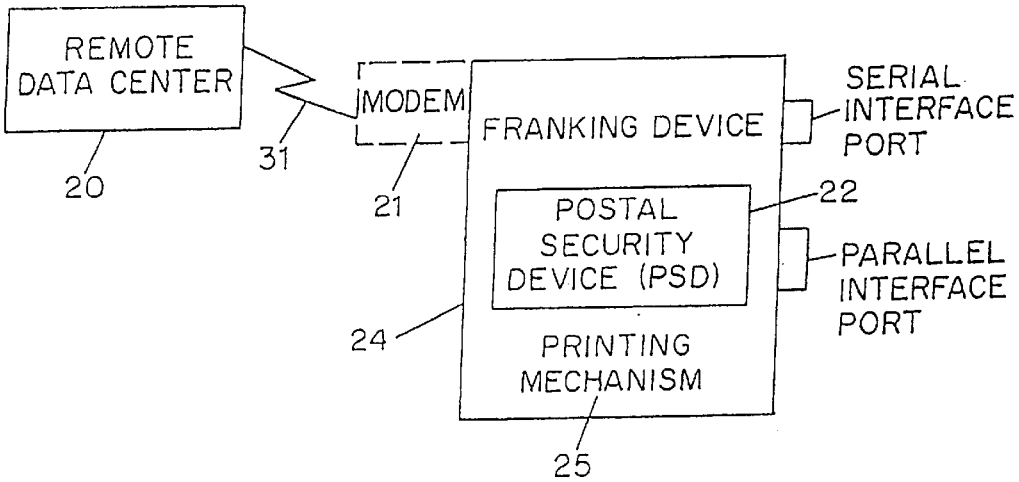
FIG. 2 is a functional block diagram of a second embodiment of a closed-system type of postage meter.

In the second embodiment of this closed system employment, as shown in FIG. 2, the Postal Security Device (PSD) 22 is internal to the franking device 24 and is disposed to the same security requirements of the first embodiment. Crediting new funds to the PSD is managed by an interface (modem) 21 adapted to the franking device 24 which communicates cryptographically with a host Data Center 20 which provide funds for the PSD 22 through the franking device 24. The communications between the franking device 24 and Data Center 20 or between the franking device 24 and PSD 22 are cryptographically encoded with all transactions being verified by the crypto-code structure and certificate authorization schema as required by the regulating body. The communications between the franking device 24 and data center 20 may desirably be carried out as set forth in U.S. Pat. No. 5,237,506, assigned to the same assignee as the assignee of the present invention. Said PSD 22 is not accessible for removal from the franking device 24. Attempts to do so or to modify PSD contents will be met with its fail safe ability to secure itself and its internal registers as required by the regulatory authority.

Figure 3:
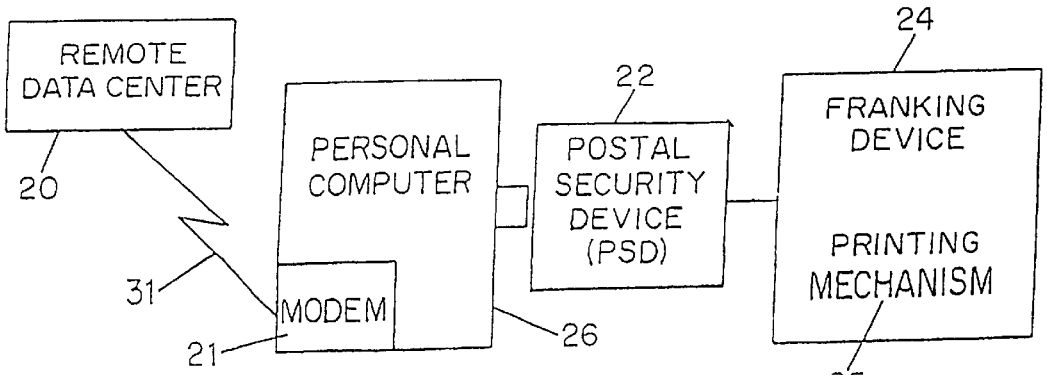
FIG. 3 is a functional block diagram of a third embodiment of a closed-system type of postage meter.

In the third embodiment of this closed system employment, the Postal Security Device (PSD) 22 is interfaced to a personal computer 26 as is shown in FIG. 3.

The PSD 22 is credited with funds via communications (typically modem) between the personal computer (PC) 26 and associated Data Center 20. The communications between the PC 26 and Data Center 20 follow the cryptographic security rules and signature verifications required by the regulatory body. The communications between the PC 26 and data center 20 may desirably be carried out as set forth in U.S. Pat. No. 5,237,506, assigned to the same assignee as the assignee of the present invention. Further, the secure communications between the PSD 22 and the remote franking device 24 are likewise assured.

The PC 26 is programmed so that it can receive a request from a user for the printing of postage, and forward information about the request to the PSD 22. The PSD 22 provides cryptographically secured data which will be contained in the postal indicium, and this data is provided eventually to a printer for printing.

It should be appreciated that the particular cryptographic standards employed in generating the data for the indicium are specified by the postal authorities, and thus that the particular cryptographic standard employed is not critical to the invention. Likewise, the form of indicium (e.g. 1-D or 2-D bar code and other aspects of layout) are also specified by the postal authorities and thus are not critical to the invention.

The PSD device 22, evident in the first and third embodiments (FIGS. 1 and 3), present the opportunity for physically relocating said PSD 22 from a system configuration evidenced in FIG. 1 to a different system configuration evidenced in FIG. 3, or vice versa. Said PSD 22 has the capability of optionally containing pertinent information regarding the system adaptation to which it is incorporated, including such parametric data as host serial numbers, register readings, and the like. The PSD 22 noted in FIG. 3 could be located in or on the Franking Device 24, to wit, the PC 26 would communicate to the Franking Machine's PSD via any PC compatible communications link (e.g. RS232, parallel, etc.).

Figure 4:
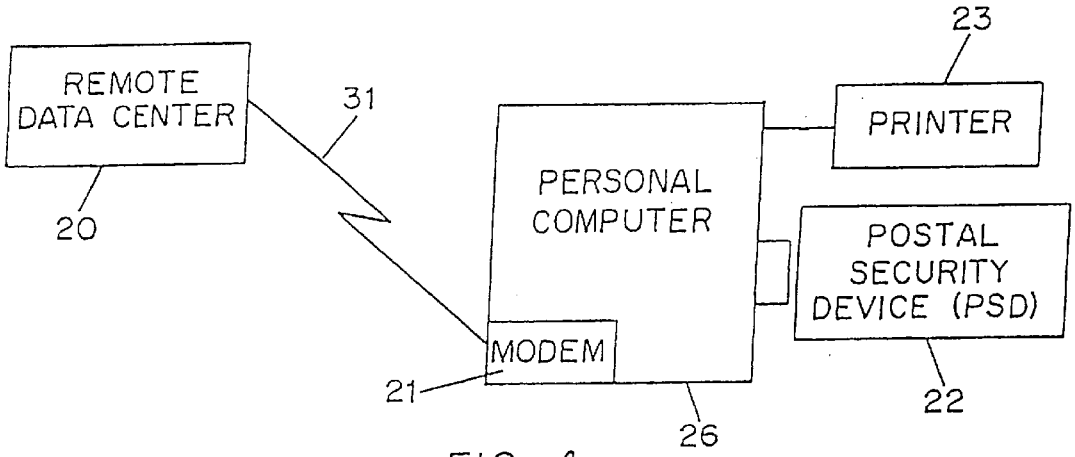
FIG. 4 is a functional block diagram of a first embodiment of an open-system type of postage meter.

The Open System (OS) arrangement, which may take the form of five different embodiments, will now be described. The selection of the particular embodiment is determined by the needs of the customer. This employment provides a printing means 23 outside a franking device. Said printing means 23 is any commercially available printing means capable of reproducing the franked image content, makeup and resolution in accordance with regulatory requirements addressing said franked image content, makeup and resolution. In all cases and embodiments, the cryptographic content of the printed indicia image contains information unique to that transaction and specific PSD. In the first embodiment of this open system arrangement, as shown in FIG. 4, the PSD 22 is interfaced to a Personal Computer (PC) 26 communication port. Also interfaced to the same PC 26 is a printer 23 capable of reproducing the franked image content, makeup and resolution in accordance with regulatory requirements.

Crediting new funds to the PSD 22 is managed by an interface (modem) 21 adapted to the PC 26 which communicates cryptographically with a host Data Center 20 which provide funds for the PSD 22 through the PC 26. The communications between the Data Center 20 and PSD 22 are cryptographically encoded with all transactions being verified by the crypto-code structure and certificate authorization schema as required by the regulating body. The communications between the PSD 22 and data center 20 may desirably be carried out as set forth in U.S. Pat. No. 5,237,506, assigned to the same assignee as the assignee of the present invention. Said PSD may be moved from one PC 26 to another. Further, said PSD 22 may be relocated to a Closed System (CS) embodiment such as that set forth in FIGS. 1 and 3.

Figure 5:
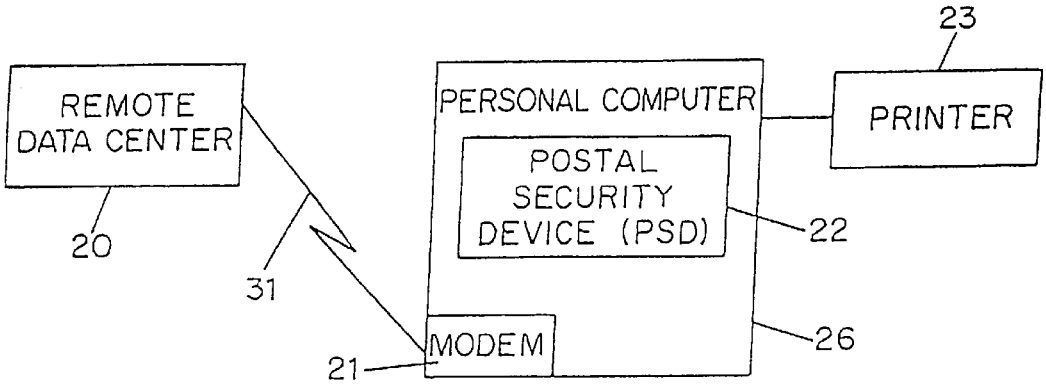
FIG. 5 is a functional block diagram of a second embodiment of an open-system type of postage meter.

In the second embodiment of an Open System arrangement, the PSD 22 is internally interfaced to a Personal Computer (PC) 26 as is shown in FIG. 5. Also interfaced to the same PC 26 is a printer 23 capable of reproducing the franked image content, makeup and resolution in accordance with regulatory requirements.

This embodiment of the Postal Security Device (PSD) 22 is subjected to the same security requirements as are applicable in the first embodiment. Crediting new funds to the PSD 22 is managed by interface (modem) 21 adapted to the PC 26 which communicates cryptographically with a host Data Center 20 which provide funds for the PSD 22 through the PC 26. The communications between the Data Center 20 and PSD 22 are cryptographically encoded with all transactions being verified by the crypto-code structure and certificate authorization schema as required by the regulating body. The communications between the PSD 22 and data center 20 may desirably be carried out as set forth in U.S. Pat. No. 5,237,506, assigned to the same assignee as the assignee of the present invention.

Figure 6A:
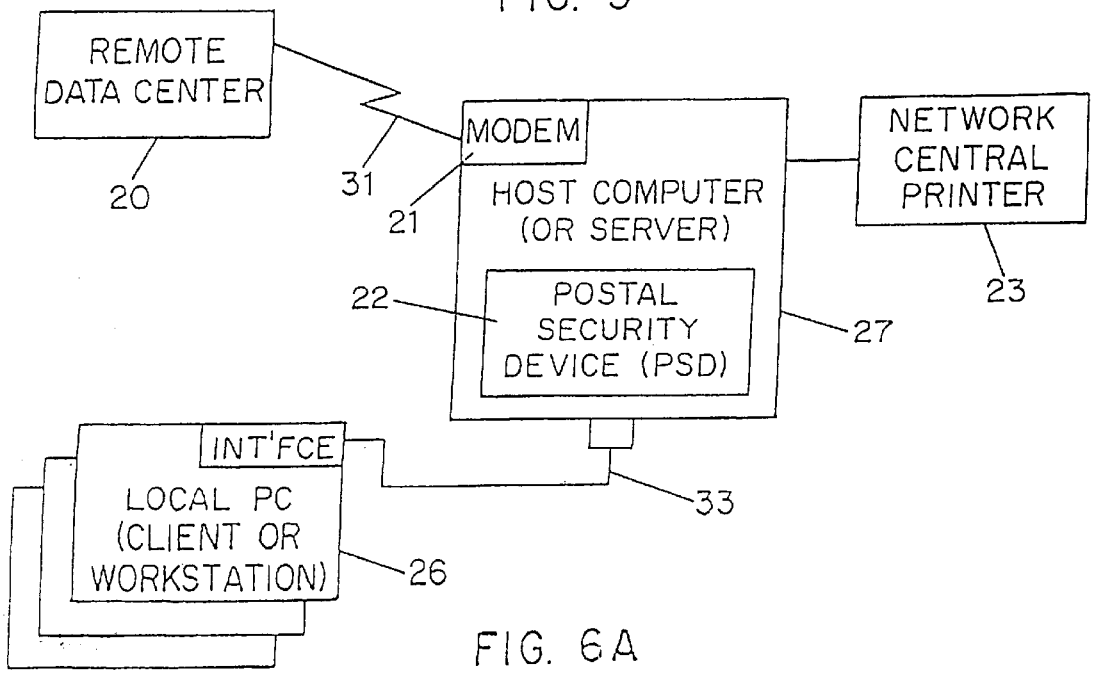
FIG. 6A is a functional block diagram of a third embodiment of an open-system type of postage meter, with an internally mounted postal security device (PSD)
Figure 6B:
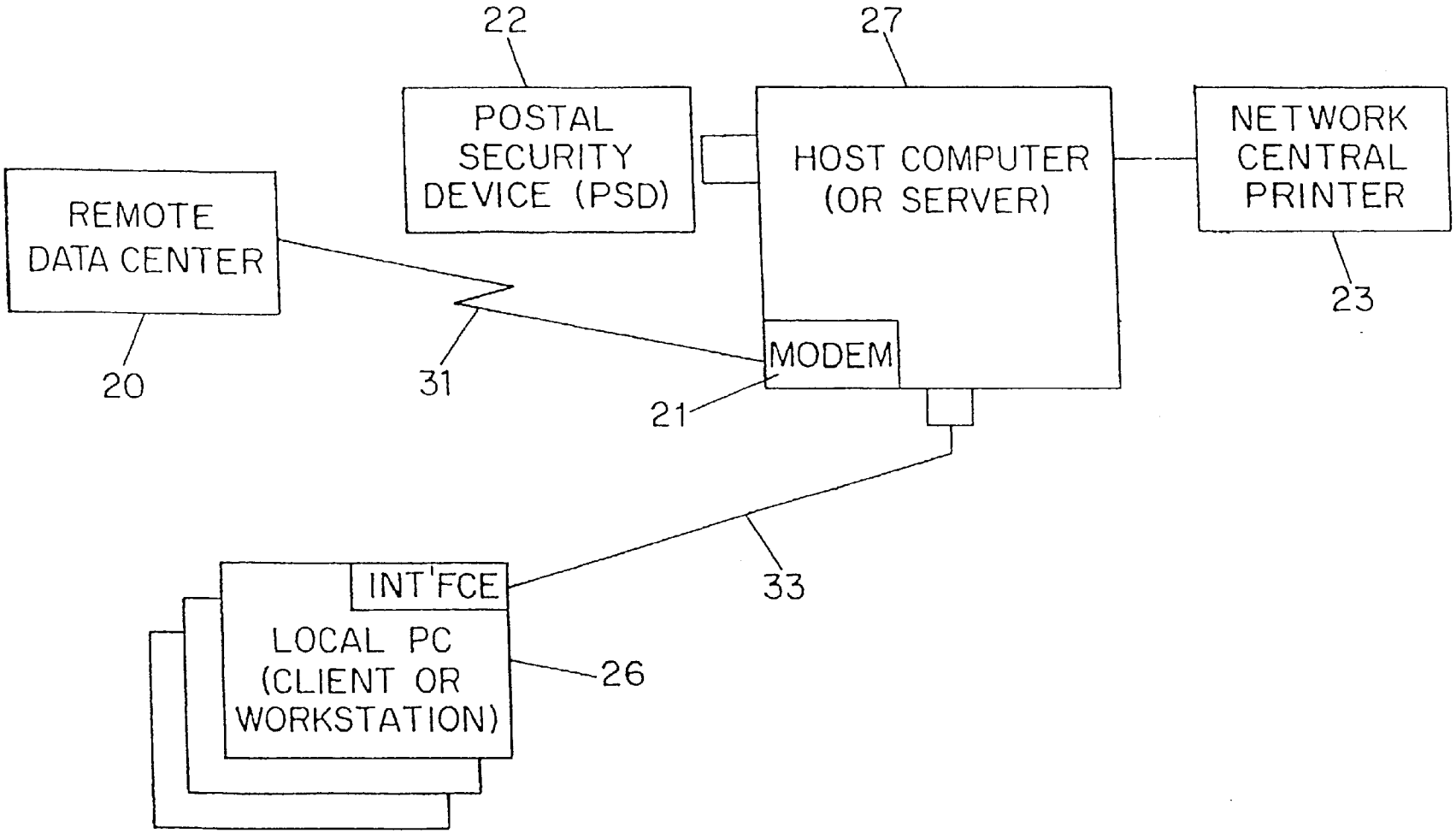
FIG. 6B is a functional block diagram of a third embodiment of an open-system type of postage meter, with an externally mounted PSD.

In the third embodiment of an Open System arrangement, the PSD 22 is internally mounted (FIG. 6A) or externally interfaced (FIG. 6B) to a networked host 27. Networked to the host 27 are one or more Personal Computers (PC) 26. The printing device 23 is interfaced to the host 27, as might be the case in a centralized mailing application. The printer 23 is capable of reproducing the franked image content, makeup and resolution in accordance with regulatory requirements.

This embodiment of the Postal Security Device (PSD) 22 is subjected to the same security requirements as in the other embodiments. Crediting new finds to the PSD 22 is managed by interface (modem) 21 adapted to the Networked host which communicates cryptographically with a host Data Center 20 which provide funds for the PSD 22 through the Networked host 27. The communications between the Data Center 20 and PSD 22 are cryptographically encoded with all transactions being verified by the crypto-code structure and certificate authorization schema as required by the regulating body. The communications between the PSD 22 and data center 20 may desirably be carried out as set forth in U.S. Pat. No. 5,237,506, assigned to the same assignee as the assignee of the present invention.

The Networked host 27 provides its interfaced printer 23 with the indicia representing addressing and postage value information requested by the local PCs 26 in accordance with indicia context requirements of the regulatory body. The PSD 22 depicted in FIG. 6B may be moved to any other Open or Closed system application interfacing the PSD 22 in a like manner.

Figure 7A:
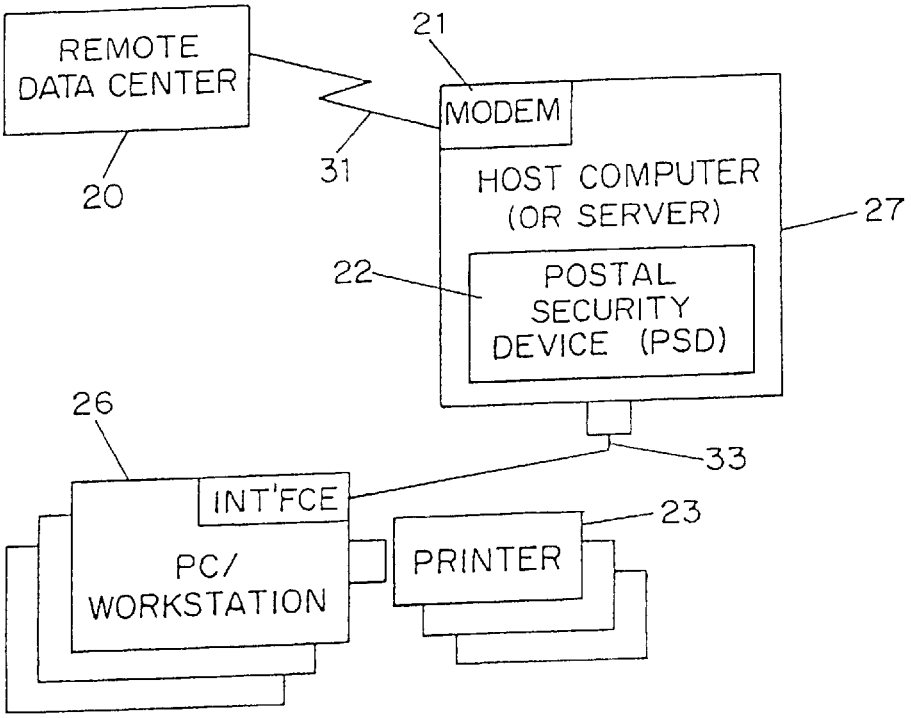
FIG. 7A is a functional block diagram of a fourth embodiment of an open-system type of postage meter, with an internally mounted postal security device (PSD)
Figure 7B:
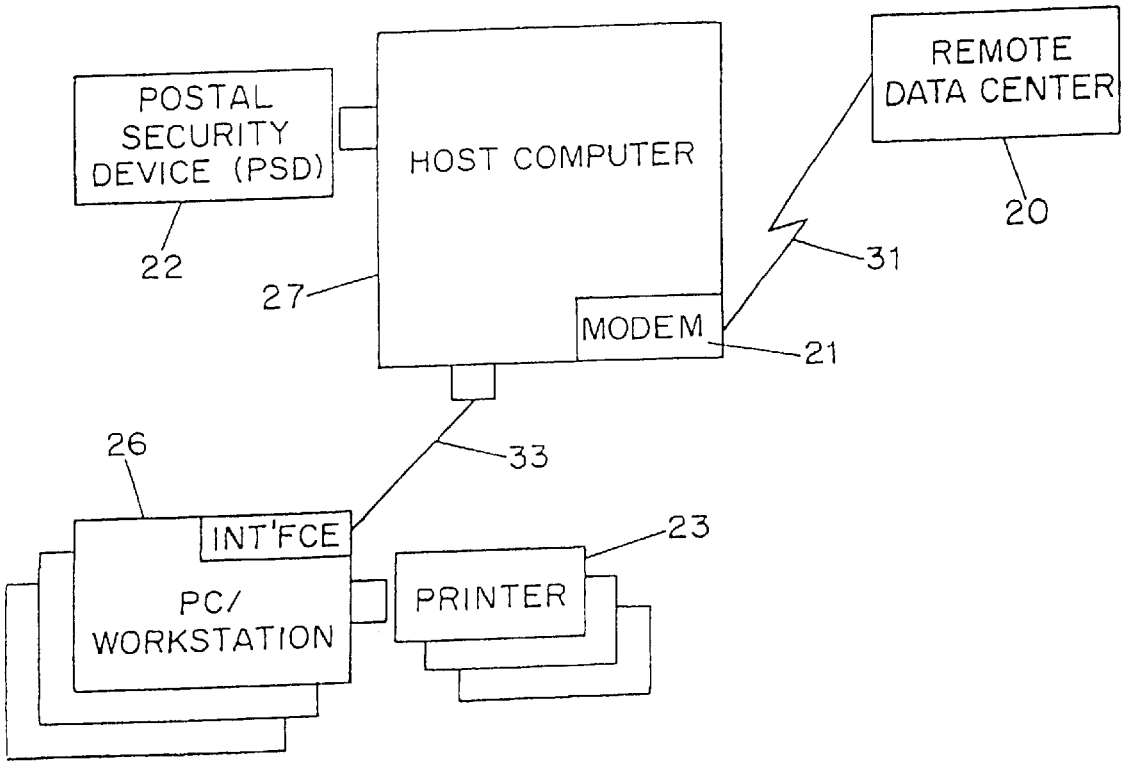
FIG. 7B is a functional block diagram of a fourth embodiment of an open-system type of postage meter, with an externally mounted PSD.

In the fourth embodiment of an Open System arrangement, the printing devices 23 are interfaced to local Personal Computers 26, rather than to a Networked host 27. FIGS. 7A and 7B present the described configuration. FIG. 7A defines the Networked host 27 with its PSD 22 internally mounted while FIG. 7B shows the PSD 22 externally interfaced to the Networked host 27. However, the PSD 22 depicted in FIG. 7B may be moved to any other Open or Closed system application interfacing the PSD 22 in a like manner.

Figure 8:
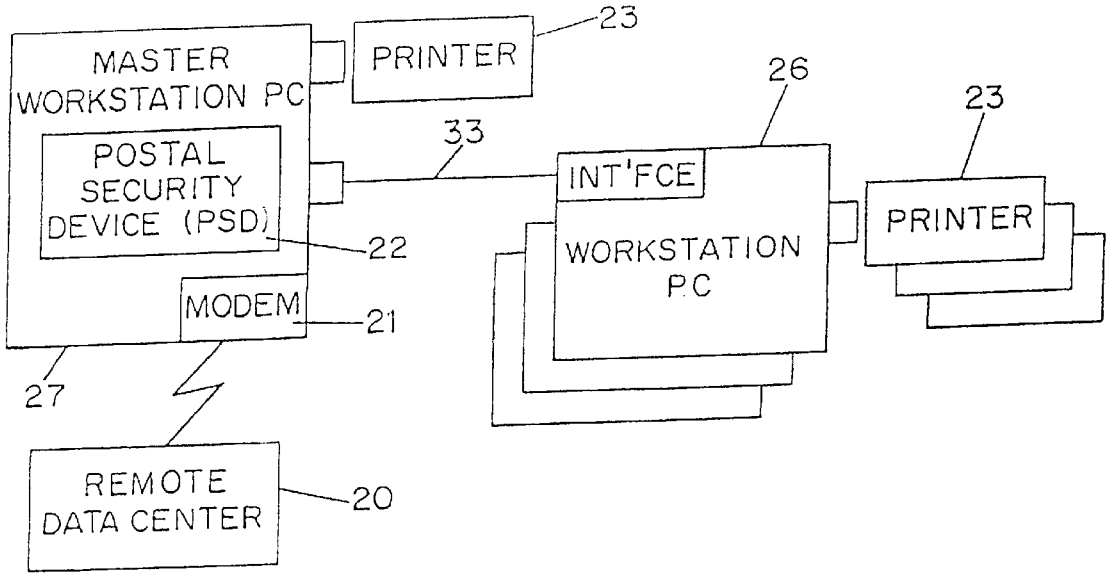
FIG. 8 is a functional block diagram of a fifth embodiment of an open-system type of postage meter.

In a fifth embodiment of an Open System arrangment, the printing devices 23 are interfaced to either local Personal Computers 26 or a master/host workstation 27 as shown in FIG. 8. A single PSD 22 can support one or more indicium application sources from a master workstation 27. This embodiment is typical of a decentralized office environment where indicium applications occur at different workstations 26. However, only one workstation 27 in the local network loop 33 need have the PSD 22. All work stations 26 have the ability to produce secure indicia.

This embodiment of the Postal Security Device (PSD) 22 is subjected to the same security requirements as in the previously described embodiments. Crediting new finds to the PSD 22 is managed by interface (modem) 21 adapted to the workstation 27 to which the PSD 22 is attached which communicates cryptographically with a remote host Data Center 20 which, in turn, provides funds for the PSD through the workstation 27 to which the PSD 22 is attached. The workstation 27 to which the PSD 22 is attached provides its interfaced printer 23 and/or one or more of its interfaced workstations 26 with the indicia representing addressing and postage value information requested by the associated workstation 23 in accordance with indicia context requirements of the regulatory body. The PSD 22 depicted in FIG. 8 may be moved to any other Open or Closed system application interfacing the PSD 22 in a like manner.

Figure 9A:
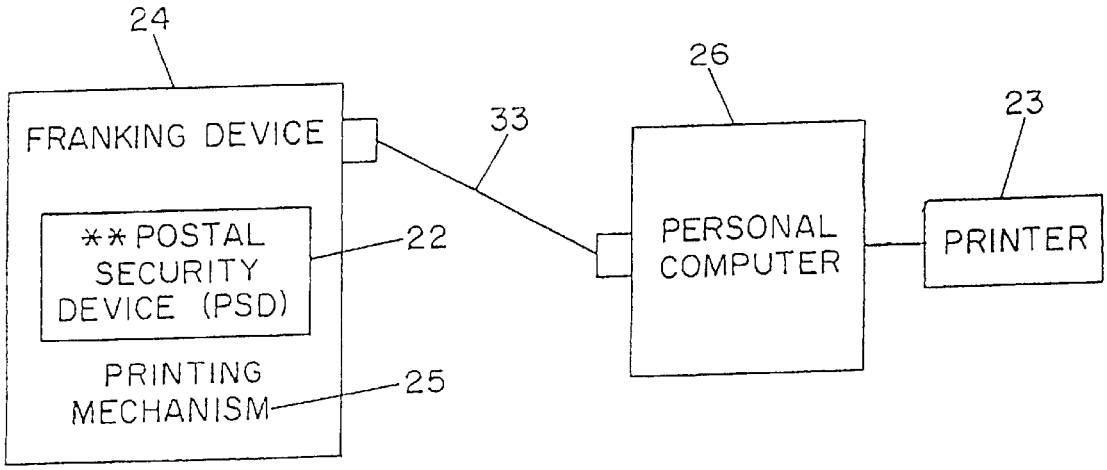
FIG. 9A is a functional block diagram of a first embodiment of a hybrid of a closed-system and open-system type of postage meter.
Figure 9B:
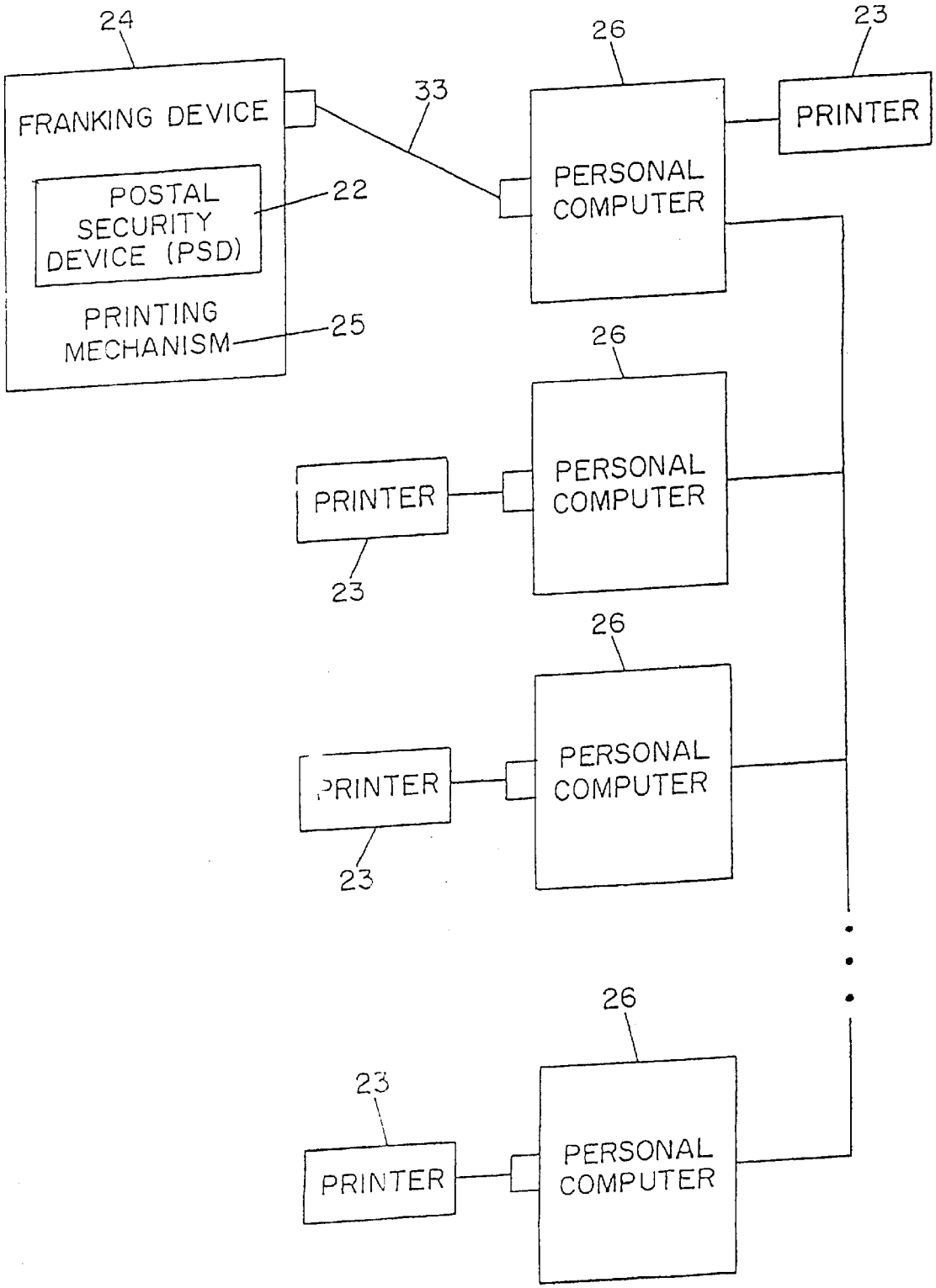
FIG. 9B is a functional block diagram of a second embodiment of a hybrid of a closed-system and open-system type of postage meter.

Finally, hybrid systems may be employed in which a Closed System (CS) franking device is interfaced to an Open System (OS) Personal Computer-based system which may take the form of two different embodiments, dependent upon the needs of the customer, as disclosed in FIGS. 9A and 9B. Such a system provides the ability for a CS, typified in FIG. 2 whose PSD may be internal to the franking device as disclosed in FIG. 2, or external to the franking device, as disclosed in FIG. 1. The FIG. 9A embodiment depicts said franking device interfaced to an external Personal Computer (PC) 26 which requests and receives proof of postage data from the CS franking device 24 for application to a mailpiece being processed through its (the PCs) own dedicated printer 23.

Alternately as shown in FIG. 9B, said PC 24 may be networked to one or more Personal Computers 26 with each of those PCs 26 accessing one or more printers 23. Said printing means relates to any commercially available printing means capable of reproducing the franked image content, makeup and resolution in accordance with regulatory requirements addressing said franked image content, makeup and resolution. In each embodiments, the cryptographic content of the printed indicia image contains information unique to that transaction and specific PSD.

In summary, the following have been disclosed:

The PSD 22 via the "dongle" or other adaptive interfacing device which connects to and uses a communications port while still allowing the port to be used by other devices interface may be connected to a device not previously predisposed to accepting installation of said PSD 22.

The PSD 22 can be credited with new or additional funds via a modem 21 within or external to the PSDs host.

The PSD 22 can be credited with new or additional funds via a communications port (e.g. RS232) on the PSDs host. The host, in turn, utilizes its internal or external modem to contact a remote central Data Center for downloading of funds to be credited to the PSD 22.

The PSD 22 may be removed from its host and connected to the parallel or serial port of a PC 26 with modem communications ability wherein said PC would communicate with a remote central Data Center to download funds into the PSD. The PSD would then be returned to its operational host.

The PSD may be connected directly to a PC wherein:

A postage metering device obtains a postmark (indicium) data from said PC, operating in a Closed System (CS) environment.

A PC software can obtain a postmark (indicium) data from the same PSD in either an OS or CS.

A PC can be networked and share a single PSD with associated PCs/workstations in an OS.

While a PSD is connected to a postage metering device it is able to:

Output postmarks (indicium) data to a PC connected to the postage metering device's communication port (e.g. RS232) when operating in an Open System (OS) franking environment.

The postage metering device configured as a Personal Computer (PC) is capable of being networked to one or more PCs to support multiple OS franking workstations.

While the invention has been described with respect to particular embodiments and figures, it should be understood that the invention is not limited to those particular embodiments and figures. Indeed, those skilled in the art will readily identify numerous obvious variations of the invention, all of which are within the invention, as defined by the claims that follow.

What is claimed is:

1. A system for printing postal indicia, the system comprising:

a postage meter containing, within a secure housing, a printing mechanism and a postal security device, said postal security device containing an accounting register indicative of postage value, and containing cryptographic means, said cryptographic means disposed for secure communications with a remote host for adjustment of the contents of said accounting register, said cryptographic means further disposed for generation of data to be included in said postal indicia, said postal security device disposed to account within said accounting register for postage value provided in said postal indicia and to fail to generate such data when said accounting-register is in predetermined relationship with an amount of postage value to be printed;

said postage meter communicatively coupled with a plurality of personal computers, each personal computer connected with a corresponding printer;

each of said personal computers programmed to receive requests from respective users for the printing of postal indicia, and to receive generated data from the postal security device responsive to the requests, and to print postal indicia within which the generated data is provided.

2. The system of claim 1 wherein the postage meter and personal computers are communicatively coupled via a local-area network.

3. The system of claim 2 wherein the postage meter and personal computers are communicatively coupled via TCP/IP.

4. A system for printing postal indicia, the system comprising:

a postage meter containing, within a secure housing, a printing mechanism and a first cryptographic means;

said postage meter communicatively coupled with a postal security device, said postal security device containing an accounting register indicative of postage value, and containing second cryptographic means, said second cryptographic means disposed for secure communications with a remote host for adjustment of the contents of said accounting register, said second cryptographic means further disposed for generation of data to be communicated in cryptographically secure communication with the first cryptographic means for inclusion in said postal indicia, said postal security device disposed to account within said accounting register for postage value provided in said postal indicia and to fail to generate such data when said accounting register is in predetermined relationship with an amount of postage value to be printed;

said postage meter communicatively coupled with a plurality of personal computers, each personal computer connected with a corresponding printer;

each of said personal computers programmed to receive requests from respective users for the printing of postal indicia, and to receive generated data from the postal security device responsive to the requests, and to print postal indicia within which the generated data is provided.

5. The system of claim 4 wherein the postage meter and personal computers are communicatively coupled via a local-area network.

6. The system of claim 5 wherein the postage meter and personal computers are communicatively coupled via TCP/IP.

7. A system for printing postal indicia, the system comprising:

a postage meter containing, within a secure housing, a printing mechanism and a postal security device, said postal security device containing an accounting register indicative of postage value, and containing cryptographic means, said cryptographic means disposed for secure communications with a remote host for adjustment of the contents of said accounting register, said cryptographic means further disposed for generation of data to be included in said postal indicia, said postal security device disposed to account within said accounting register for postage value provided in said postal indicia and to fail to generate such data when said accounting register is in predetermined relationship with an amount of postage value to be printed;

said postage meter communicatively coupled with a personal computer, said personal computer connected with a corresponding printer;

said personal computer programmed to receive requests from a respective user for the printing of postal indicia, and to receive generated data from the postal security device responsive to the requests, and to print postal indicia within which the generated data is provided.

8. The system of claim 7 wherein the postage meter and personal computer are communicatively coupled via a local-area network.

9. The system of claim 8 wherein the postage meter and personal computers are communicatively coupled via TCP/IP.

10. A system for printing postal indicia, the system comprising:

a postage meter containing, within a secure housing, a printing mechanism and a first cryptographic means;

said postage meter communicatively coupled with a postal security device, said postal security device containing an accounting register indicative of postage value, and containing second cryptographic means, said second cryptographic means disposed for secure communications with a remote host for adjustment of the contents of said accounting register, said second cryptographic means further disposed for generation of data to be communicated in cryptographically secure communication with the first cryptographic means for inclusion in said postal indicia, said postal security device disposed to account within said accounting register for postage value provided in said postal indicia and to fail to generate such data when said accounting register is in predetermined relationship with an amount of postage value to be printed;

said postage meter communicatively coupled with a personal computer, said personal computer connected with a corresponding printer;

said personal computer programmed to receive requests from a respective user for the printing of postal indicia, and to receive generated data from the postal security device responsive to the requests, and to print postal indicia within which the generated data is provided.

11. The system of claim 10 wherein the postage meter and personal computer are communicatively coupled via a local-area network.

12. The system of claim 11 wherein the postage meter and personal computer are communicatively coupled via TCP/IP.

13. A system for printing postal indicia, the system comprising:

a first personal computer, said first personal computer connected with a respective printer;

said first personal computer communicatively coupled with a postal security device, said postal security device containing an accounting register indicative of postage value, and containing a cryptographic means, said cryptographic means disposed for secure communications with a remote host for adjustment of the contents of said accounting register, said cryptographic means further disposed for generation of data to be included in said postal indicia, said postal security device disposed to account within said accounting register for postage value provided in said postal indicia and to fail to generate such data when said accounting register is in predetermined relationship with an amount of postage value to be printed;

said first personal computer communicatively coupled with a plurality of second personal computers, said second personal computers each connected with a corresponding printer;

each of said second personal computers programmed to receive requests from a respective user for the printing of postal indicia, and to receive generated data from the postal security device responsive to the requests, and to print postal indicia within which the generated data is provided.

14. The system of claim 13 wherein the first personal computer and second personal computers are communicatively coupled via a local-area network.

15. The system of claim 14 wherein the first personal computer and second personal computers are communicatively coupled via TCP/IP.

16. A system for printing postal indicia, the system comprising:

a first personal computer;

said first personal computer communicatively coupled with a postal security device, said postal security device containing an accounting register indicative of postage value, and containing a cryptographic means, said cryptographic means disposed for secure communications with a remote host for adjustment of the contents of said accounting register, said cryptographic means further disposed for generation of data to be included in said postal indicia, said postal security device disposed to account within said accounting register for postage value provided in said postal indicia and to fail to generate such data when said accounting register is in predetermined relationship with an amount of postage value to be printed;

said first personal computer communicatively coupled with a plurality of second personal computers, said second personal computers each connected with a corresponding printer;

each of said second personal computers programmed to receive requests from a respective user for the printing of postal indicia, and to receive generated data from the postal security device responsive to the requests, and to print postal indicia within which the generated data is provided.

17. The system of claim 16 wherein the first personal computer and second personal computers are communicatively coupled via a local-area network.

18. The system of claim 17 wherein the first personal computer and second personal computers are communicatively coupled via TCP/IP.

19. A system for printing postal indicia, the system comprising:

a first personal computer, said first personal computer connected with a first printer;

said first personal computer communicatively coupled with a postal security device, said postal security device containing an accounting register indicative of postage value, and containing a cryptographic means, said cryptographic means disposed for secure communications with a remote host for adjustment of the contents of said accounting register, said cryptographic means further disposed for generation of data to be included in said postal indicia, said postal security device disposed to account within said accounting register for postage value provided in said postal indicia and to fail to generate such data when said accounting register is in predetermined relationship with an amount of postage value to be printed;

said first personal computer communicatively coupled with a plurality of second personal computers;

each of said second personal computers programmed to receive requests from a respective user for the printing of postal indicia and to communicate said requests to said first personal computer, said first personal computer programmed to respond to such requests by receiving generated data from the postal security device responsive to the requests, and to print on said first printer postal indicia within which the generated data is provided.

20. The system of claim 19 wherein the first personal computer and second personal computers are communicatively coupled via a local-area network.

21. The system of claim 20 wherein the first personal computer and second personal computers are communicatively coupled via TCP/IP.

* * * * *